US005893419A

United States Patent [19]

Hodges

[11] Patent Number: 5,893,419

[45] Date of Patent: Apr. 13, 1999

[54] HYDRAULIC IMPACT TOOL

[75] Inventor: Richard N. Hodges, Arlington, Tex.

[73] Assignee: FM Industries, Inc., Fort Worth, Tex.

[21] Appl. No.: 08/780,319

[22] Filed: Jan. 8, 1997

[51] Int. Cl.[6] ..... B25D 9/02

[52] U.S. Cl. ..... 173/13; 173/204; 173/206; 173/19; 173/208; 91/300

[58] Field of Search ..... 173/206, 204, 173/128, 13, 15, 17, 19, 208; 91/519, 220, 300, 321

[56] References Cited

U.S. PATENT DOCUMENTS

| | | | |
|---|---|---|---|
| 1,065,335 | 6/1913 | Barton et al. . | |
| 1,065,339 | 6/1913 | Brazelle . | |
| 1,319,034 | 10/1919 | App . | |
| 2,598,455 | 5/1952 | Smith . | |
| 2,748,751 | 6/1956 | Johnson . | |
| 3,321,033 | 5/1967 | Benuska . | |
| 3,339,644 | 9/1967 | Klessig . | |
| 3,626,695 | 12/1971 | Jonsson . | |
| 3,739,863 | 6/1973 | Wohlwend . | |
| 3,766,830 | 10/1973 | Montabert . | |
| 3,827,507 | 8/1974 | Lance | 173/204 |
| 3,887,019 | 6/1975 | Reynolds et al. . | |
| 3,965,799 | 6/1976 | Juvonen et al. . | |
| 3,995,700 | 12/1976 | Mayer et al. . | |
| 4,018,135 | 4/1977 | Lance et al. . | |
| 4,039,033 | 8/1977 | Salmi . | |
| 4,062,268 | 12/1977 | Hibbard . | |
| 4,062,411 | 12/1977 | Adkins et al. . | |
| 4,073,350 | 2/1978 | Eklöf et al. . | |
| 4,075,868 | 2/1978 | Frederick . | |
| 4,133,394 | 1/1979 | Wohlwend . | |
| 4,165,788 | 8/1979 | Montabert . | |
| 4,181,183 | 1/1980 | Okada . | |
| 4,231,434 | 11/1980 | Justus . | |
| 4,264,107 | 4/1981 | Janach et al. . | |
| 4,380,901 | 4/1983 | Rautimo et al. . | |
| 4,466,493 | 8/1984 | Wohlwend . | |
| 4,505,340 | 3/1985 | Yantsen et al. | 173/204 |
| 4,552,227 | 11/1985 | Wohlwend . | |
| 4,676,323 | 6/1987 | Henriksson . | |
| 4,724,912 | 2/1988 | Miyazaki et al. . | |
| 4,745,981 | 5/1988 | Buske . | |
| 4,852,664 | 8/1989 | Terada et al. . | |
| 4,872,516 | 10/1989 | MacFarlane et al. | 173/206 |
| 4,945,998 | 8/1990 | Yamanaka . | |
| 4,951,757 | 8/1990 | Hamada et al. | 173/204 |
| 4,993,504 | 2/1991 | Rodert et al. . | |
| 5,005,656 | 4/1991 | Rodert . | |
| 5,134,989 | 8/1992 | Akahane | 173/206 |
| 5,458,205 | 10/1995 | Wijk | 173/206 |
| 5,477,932 | 12/1995 | Asakura et al. | 173/206 |

*Primary Examiner*—Scott A. Smith
*Attorney, Agent, or Firm*—James E. Bradley

[57] ABSTRACT

A hydraulically driven hammer has a piston which contains metal piston rings on a constant diameter section. The housing has a plurality of axially spaced apart radial ports that extend through the housing into the bore. A valve supplies fluid to the ports to control reciprocation of the piston.

7 Claims, 5 Drawing Sheets

HYDRAULIC IMPACT TOOL

TECHNICAL FIELD

This invention relates in general to tools for delivering blows, and in particularly to a hydraulically actuated impact tool.

BACKGROUND ART

Hydraulically actuated hammers, also called impact tools or breakers, are used for breaking up rock, concrete and the like. The impact tool is typically mounted to a backhoe which pushes it against the rock to be disintegrated. Hydraulic fluid pressure is supplied to a valve, which causes a piston within the impact tool to cycle to deliver blows to a working tool, such as a chisel. A gas and fluid compression chamber at one end supplies energy along with the hydraulic fluid power to deliver the blow.

Typically the piston fits very closely within a bore of the housing. Normally, there are no seals on the piston because of one or more ports that extend radially into the bore for supplying the hydraulic fluid. The ports would damage any seals located on the piston. Therefore, to provide sealing, extremely close clearances as small as 0.0001 inch are used between the piston and the bore.

The close tolerances add to the manufacturing cost. Also, as the piston wears, it is expensive to replace. In addition, the close clearances cause heat buildup.

DISCLOSURE OF INVENTION

The hydraulic hammer of this invention has a tubular housing with an axial bore. A piston is reciprocally carried in the bore. The piston has a lower pressure area and an upper pressure area which is larger than the lower pressure area. The piston moves between a lower rest or neutral position, an intermediate start position, an upper position, and then an impact position. A working tool located at the lower end of the bore is struck by the piston to deliver the blow to the workpiece. A fluid compression chamber at the upper end of the bore supplies part of the energy to drive the piston from the upper position to the impact position.

A plurality of ports extend radially through the housing into the bore. These ports include a lower supply port, a signal port located above the supply port, a return port located above the signal port, and a control port located above the return port. A valve mounts to one side of the housing for controlling fluid flow at each of the ports.

The piston has a uniform diameter section with a plurality of piston rings. The piston rings are metal split rings which slidingly engage the bore and will pass at least one of the ports. The piston rings are arranged to cooperate with the ports and an external valve to control reciprocation of the piston.

BEST MODE FOR CARRYING OUT THE INVENTION

Figure 1:
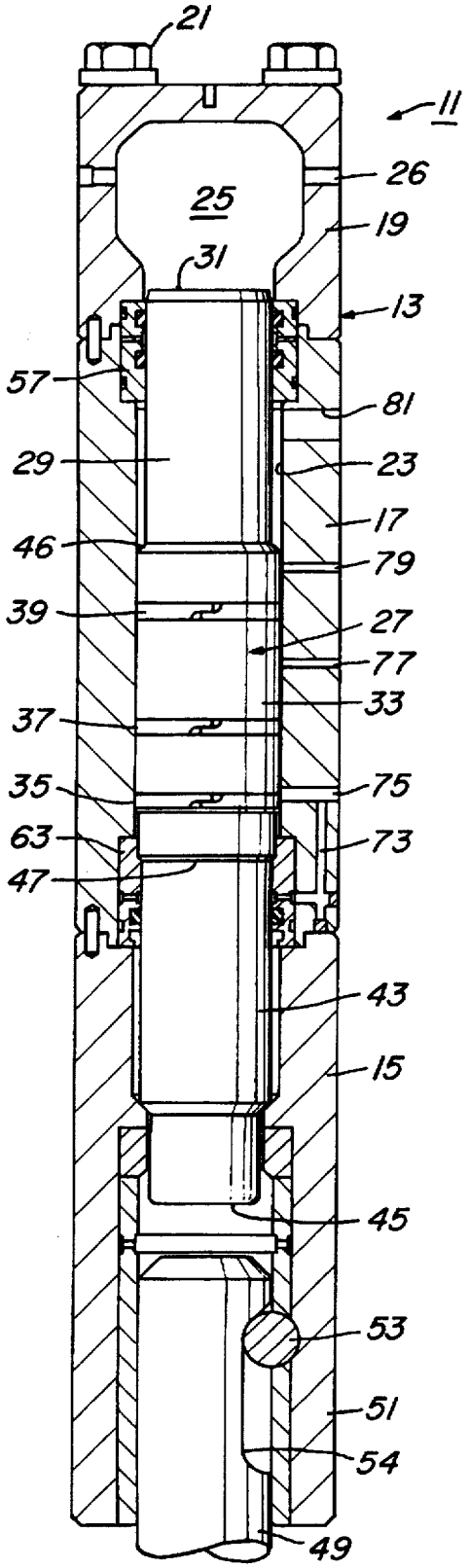
FIG. 1 is a vertical sectional view illustrating a impact tool constructed in accordance with this invention and shown in the rest position.

Referring to FIG. 1, hydraulic hammer or impact tool 11 is shown in a rest position. Impact tool 11 has a tubular housing 13. The housing 13 has a lower section 15, an intermediate section 17, and an upper section 19. The words "upper" and "lower" are used herein for convenience only, as the impact tool 11 will be used in positions other than vertical. Axially extending bolts 21 extend through the upper section 19 and intermediate section 17 into threaded holes (not shown) in the lower section 15 to hold the sections of impact tool housing 13 together. A bore 23 extends axially through housing 13. A compression chamber 25 is located at the upper end of bore 23 in upper section 19. Compression chamber 25 contains a compressible fluid, such as nitrogen gas. Compression chamber 25 is charged to a selected pressure through a charge port 26.

A piston 27 is reciprocally carried within bore 23. Piston 27 has an upward extension 29 integrally formed thereon which has an upper end 31 that extends into compression chamber 25. Piston 27 has an intermediate section 33 that joins upper extension 29. Intermediate section 33 has a constant diameter that is larger than the diameter of upper extension 29. The diameter of intermediate section 33 provides a radial clearance of about 0.025 to 0.060 inch between the intermediate section 33 and bore 23 in housing intermediate section 17.

Piston intermediate section 33 has three piston rings, comprising a lower piston ring 35, an intermediate piston ring 37, and an upper piston ring 39. Piston rings 35, 37, and 39 are split metal rings such as a type used in an internal combustion engines. Piston rings 35, 37, and 39 slidingly engage the bore 23. Piston 27 has a relieved section 41 located directly below intermediate section 33 and lower piston ring 35. Relieved section 41 is smaller in diameter than intermediate section 33, approximately 0.0100 inch smaller in the preferred embodiment.

Piston 27 has a lower extension 43 that extends downward from relieved section 41. Lower extension 43 has a lower end 45. Piston upper extension 29 has a smaller diameter than intermediate section 33, resulting in a shoulder that provides an upper pressure area 46. Piston lower extension 43 has a smaller diameter than relieved section 41, resulting in a downward facing lower shoulder providing a lower pressure area 47. The diameter of lower extension 43 is greater than the diameter of upper extension 29, resulting in lower pressure area 47 being smaller in area than upper pressure area 46.

Figure 4:
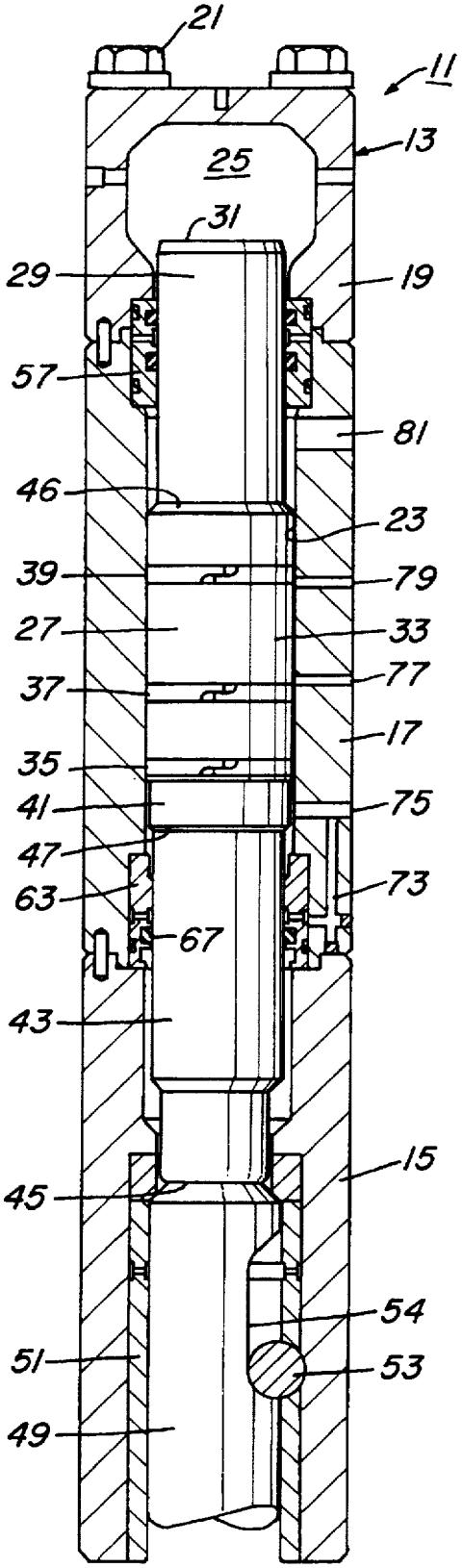
FIG. 4 is a sectional view of the impact tool of FIG. 1, showing the impact tool in an impact position.

When in the impact position shown in FIG. 4, piston lower end 45 will deliver a blow to a working tool 49. The working tool 49 will have a working end, such as a chisel. Working tool 49 is carried within bushings 51 in the bore 23 of lower housing section 15. A transverse pin 53 locates within a recess 54 in working tool 49 to retain working tool 49 with housing 13.

Figure 5:
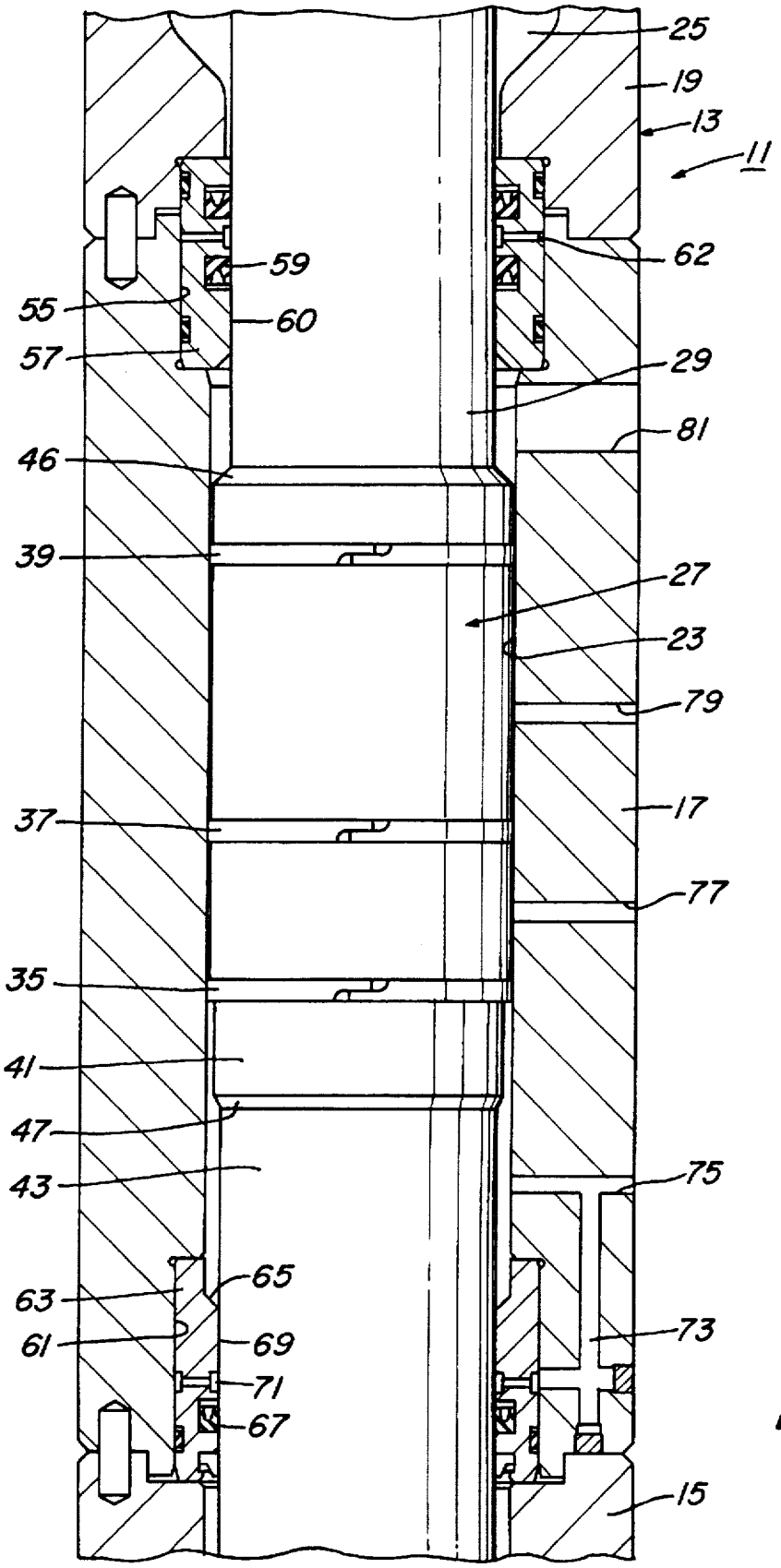
FIG. 5 is an enlarged sectional view of a portion of the impact tool of FIG. 1, showing the impact tool in an intermediate position as the piston is raising.

Referring to FIG. 5, the upper end of housing intermediate section 17 is provided with a counterbore or upper recess 55. Similarly, the lower end of housing upper section 19 is provided with a counterbore that registers and becomes a part of upper recess 55. An upper bearing 57 is removably located within upper recess 55. Upper bearing 57 may be removed from upper recess 55 by unscrewing bolts 21 (FIG. 1) and removing the upper section 19 from the intermediate section 17.

Upper bearing 57 contains a pair of upper seals 59 which are elastomeric and sealingly engage piston upper extension 29. The uppermost seal 59 is oriented upward to seal the gas in compression chamber 25. The lower of the upper seals 59 is oriented downward for sealing hydraulic oil within bore 23. A relief port 62 extends radially through upper bearing 57 and registers with a relief passage (not shown) in housing intermediate section 17. A pressure relief valve is contained within the relief passage to vent should excess pressure develop between the upper seals 59.

Upper bearing 57 has a bearing surface 60 which is located below upper seals 59 and which is closely spaced to upper extension 29 for providing radial support. The radial clearance is about 0.004 inch between bearing surface 60 and piston upper extension 29. The material of upper bearing 57 is softer than the piston upper extension 29 so that the bearing 57 will wear rather than the piston upper extension 29, and when worn sufficiently, it can be readily replaced. Piston 27 is preferably of steel, while upper bearing 57 is preferably of an aluminum bronze alloy.

Similarly, a lower recess 61 locates at the lower end of housing intermediate section 17. Lower recess 61 removably receives a lower bearing 63. Lower bearing 63 has a conical upward facing section 65 which receives the piston lower pressure area 47 when in the rest position shown in FIG. 1. Lower bearing 63 has an annular elastomeric seal 67 that slidingly engages piston lower extension 43. Lower bearing 63 has a bearing surface 69 that is located above seal 67 for providing radial support to piston lower extension 43. Lower bearing 63 is also of a softer metal than piston lower extension 43 to prevent wear to piston lower extension 43. Lower bearing 63 may be removed for replacement by disconnecting housing intermediate section 17 from lower section 15.

A relief port 71 extends through lower bearing 63. Relief port 71 includes an annular groove at the inner diameter of lower bearing 63. Relief port 71 has also a plurality of radial sections that lead to an annular groove on the outer diameter of lower bearing 63. A relief passage 73 located in housing intermediate section 17 registers with the bearing relief port 71 and also intersects a supply port 75 for communicating hydraulic oil in the bearing relief port 71 to the supply port 75. Bearing relief port 71 is located above seal 67 at the lower end of bearing surface 69.

Figure 7:
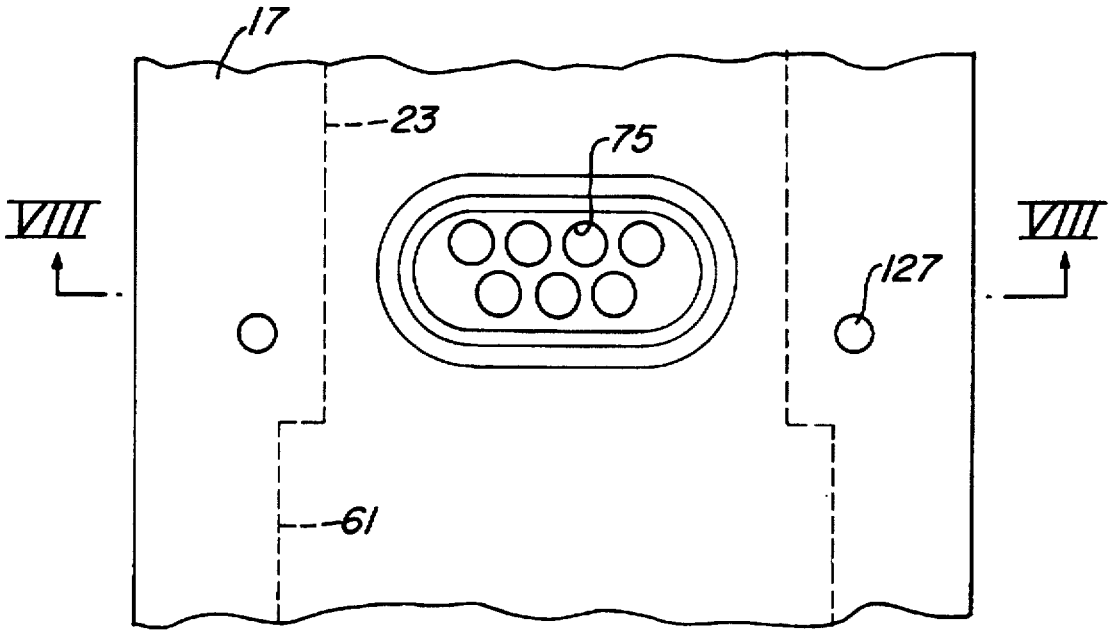
FIG. 7 is a partial side view of the housing of the impact tool of FIG. 1, shown with the valve assembly of FIG. 6 removed.
Figure 8:
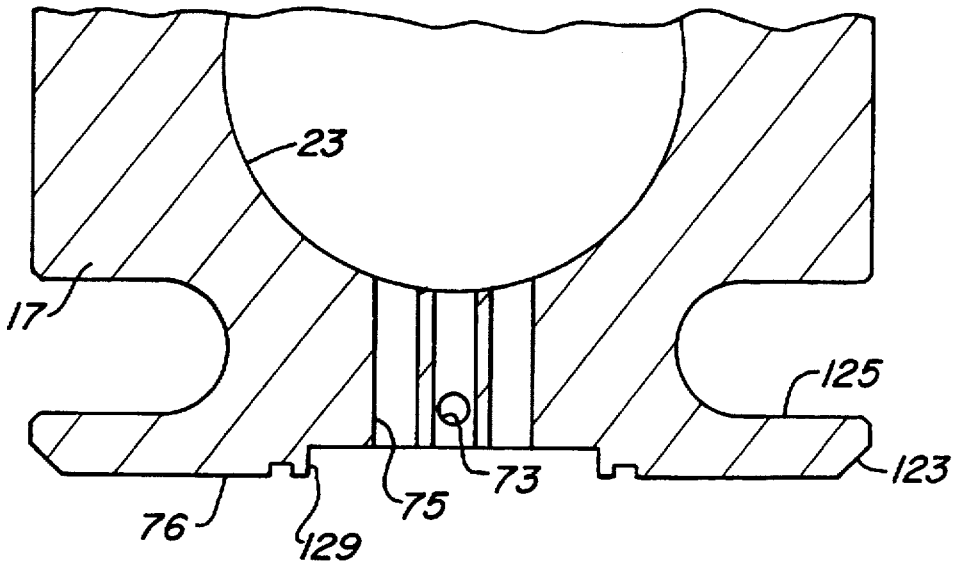
FIG. 8 is a sectional view of the impact tool of FIG. 1 taken along the line VIII—VIII of FIG. 7.

As shown in FIGS. 7 and 8, there are a plurality of supply ports 75 spaced in a cluster on a flat side 76 of housing intermediate section 17. In the preferred embodiment, there are thirteen supply ports 75, four above, five central, and three below, in a diagonal pattern. Supply ports 75 are parallel to each other. The centerlines of the four above are located in a plane perpendicular to the axis of bore 23, and the centerlines of the five central and four below are located in second and third planes perpendicular to the axis of bore 23. Each supply port 75 extends through housing intermediate section 17 for supplying hydraulic fluid to bore 23. Supply ports 75 are commonly connected to a source of pressurized hydraulic fluid.

A single signal port 77 is axially spaced above supply ports 75, and extends radially into bore 23. A single return port 79 is spaced axially above signal port 77 and extends radially into bore 23. A single control port 81 is spaced axially above return port 79 and extends radially into bore 23. Ports 75, 77, 79 and 81 all extend to bore 23 from the flat side 76 of housing intermediate section 17.

Each of the piston rings 35, 37, 39 will move past one of the ports 77, 79 during each stroke. The lower piston ring 35 moves past the supply ports 75 when moving from the neutral to the start position. To reduce damage to the piston rings 35, 37, 39 during this occurrence, each piston ring is sized to have an equal or greater width than diameter of the port that is passed, measured at the junction of the port with bore 23. For uniformity, each of the piston rings 35, 37, 39 has the same width, or axial dimension, which in the preferred embodiment is ¼ inch. The signal port 77 and control port 79 each have the same diameter, preferably ¼ inch. The multiple supply ports 75 each have a diameter that is preferably equal to or less than the piston ring width. The difference in dimension is not as great from the supply ports 75 as the signal and return ports 77, 79 because the supply ports 75 are not passed each stroke. Supply ports 75 are passed only when moving between the neutral and start positions, or when working tool 49 breaks through the media in which it is delivering blows. Control port 81 is much larger than the widths of the piston rings 35, 37, 39, but none of the piston rings passes the control port 81.

Figure 6:
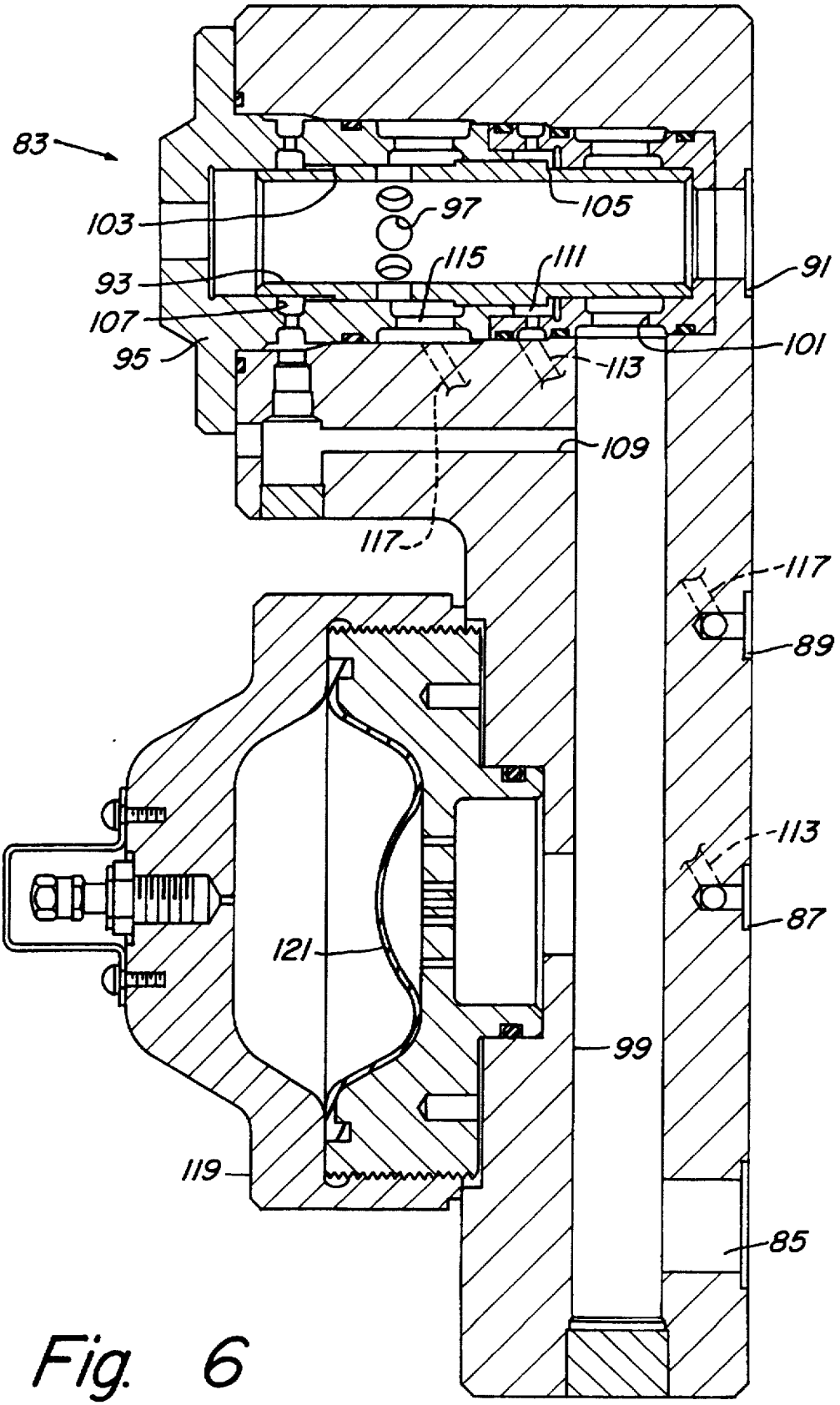
FIG. 6 is sectional view of a valve assembly utilized with the impact tool of FIG. 1.

The hydraulic fluid flow at ports 75, 77, 79, and 81 is controlled by a valve 83, shown in FIG. 6, and by positioning of the piston rings 35, 37, and 39. Valve 83 has a supply port 85 that registers with the tool supply ports 75. Similarly, valve 83 has a valve signal port 87 which registers with tool signal port 77. Valve 83 has a valve return port 89 that registers with tool return port 79. Valve 83 has a valve control port 91 that registers with tool control port 81. Valve 83 bolts directly to the flat side 76 (FIG. 8) of housing intermediate section 17 by bolts (not shown). Once bolted to housing intermediate section 17, ports 75 and 85 will be communicating, ports 77 and 87 will be co-axial, ports 79 and 89 will be co-axial, and ports 81 and 91 will be co-axial.

Valve 83 has a cylindrical tubular slider 93 that slides between an inner position shown and an outer position which will be radially outward from the position shown. Slider 93 moves on an axis that is perpendicular to the axis of housing bore 23 (FIG. 1). Slider 93 is carried within a sleeve manifold 95 which is stationary. Slider 93 has slider return ports 97 located on its sidewall between its ends. The ends of slider 93 are open, communicating its interior with control port 91 and tool control port 81 (FIG. 5).

An axial supply passage 99 is connected to a hydraulic pump (not shown) for receiving hydraulic fluid. Axial supply passage 99 joins valve supply port 85 and extends through the body of valve 83, parallel with the axis of bore 23 (FIG. 1). Supply passage 99 registers with a manifold supply port 101 located near the inner end of manifold 95. Slider 93 has an outer pressure area 103, which is an outward facing shoulder, and an inner pressure area 105, which is an inward facing shoulder spaced inward from outer pressure area 103.

A manifold bias port 107 extends through manifold 95 and is positioned so as to always be located outward of and in communication with outer pressure area 103. A bias passage 109 extends from supply passage 99 to manifold bias port 107 to provide a continuous supply of high pressure hydraulic fluid, urging slider 93 inward.

A manifold signal port 111 extends through manifold 95 and is positioned for communicating continuously with inner pressure area 105, regardless of the position of slider 93. Inner pressure area 105 has a greater pressure area than the outer pressure area 103, thus when signal port 111 receives fluid at supply pressure, slider 93 will shift outward. Manifold signal port 111 communicates with valve signal port 87 through a passage 113, which is shown by dotted lines.

A manifold return port 115 extends through manifold 95 and is positioned to communicate with slider return ports 97, but only when slider 93 is in the inner position shown. When slider 93 moves to the outer position, slider return ports 97 will not communicate with manifold return port 115. Manifold return port 115 communicates with valve return port 89 by means of a return passage 117, shown by dotted lines. Return passage 117 also leads to the reservoir or tank of the hydraulic pump (not shown). Valve 83 also has a conventional accumulator 119 which has a diaphragm 121 to maintain a constant pressure level in the supply passage 99.

Referring to FIGS. 7 and 8, housing 23 has a pair of flanges 123 on each edge of flat side 76. Recesses 125 are located on the opposite side of flanges 123 from flat side 76. Threaded holes 127 extend through the flanges 123 for receiving bolts (not shown) to bolt the valve 83 to housing 23. The cluster of supply ports 75 are located within an oval recess 129 which is enclosed by an elastomeric seal (not shown). Recess 129 registers with valve supply port 85.

In operation, as shown in FIG. 1, impact tool 11 will be in the neutral or rest position. Working tool 49 will be in a lower position supported by pin 53. Piston 27 will be in a lower position, also, but its lower end 45 will not contact the upper end of working tool 49 because working tool 49 will be in the lower position. Lower bearing 63 will support piston 27 in the lower rest position. In the neutral position, and in all of the positions, hydraulic fluid is supplied at a continuous pressure of around 2000 psi. The supply pressure will be referred to herein as a "high" and the return pressure or zero pressure will be referred to herein as a "low".

The continuous high at supply ports 75 does not cause piston 27 to move upward from the neutral position because lower pressure area 47 will be below supply ports 75. Lower piston ring 35 will be slightly below the supply ports 75, and intermediate piston ring 37 will be between supply ports 75 and signal port 77. Upper piston ring 39 will be between signal port 77 and return port 79. Upper pressure area 46 will be below control port 81. The pressure at signal port 77 will be low because intermediate piston ring 37 is located between supply ports 75 and signal port 77. The pressure at return port 79 will be continuously low. The pressure at control port 81 will be low because of the position of valve 83, as will be subsequently explained. Also, the clearances around the piston 27 above piston ring 39 communicate return port 79 with control port 81. During the full stroke of the piston 27, only the pressure at signal port 77 and control port 81 will change, with the pressure at supply ports 75 always remaining high and the pressure at return port 79 always remaining low.

Referring to the FIG. 6, during the neutral position, valve 83 will appear as shown. The high pressure in supply passage 99 communicates to the outer pressure area 103 through the bias port 107 and bias passage 109. This biases the slider 93 inward or to the right. The inner pressure area 105 will be at low because the manifold signal port 111 will be at low pressure. Control port 91 will also be low because slider 93 blocks supply port 101 when in the inner position. Also, supply port 91 is low because of the communication of return ports 97 with manifold return ports 115 and return passage 117. Throughout the entire cycle, the pressure at manifold bias port 107 remains high and continuously acts against outer pressure area 103. The pressure at manifold return port 115 continuously remains low due to its communication with the return of the hydraulic pump (not shown). The pressures at manifold signal port 111 and control port 91 will change during the stroke.

Figure 2:
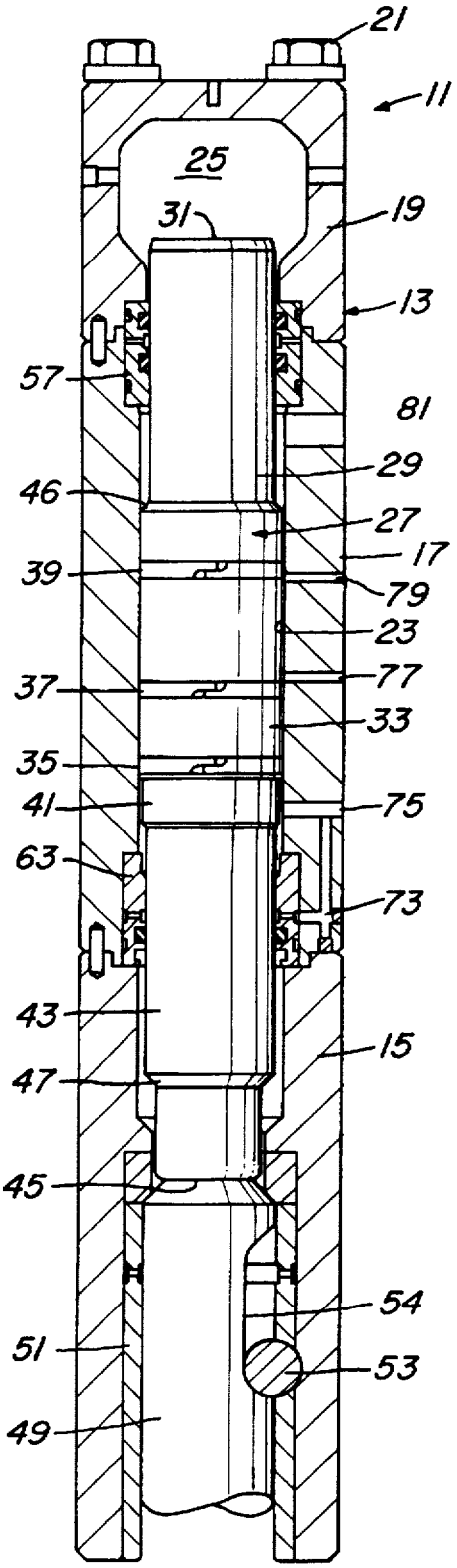
FIG. 2 is a sectional view of the impact tool of FIG. 1, showing the impact tool in a start position.

Referring now to FIG. 2, impact tool 11 is placed in the start position by moving the housing 13 toward the workpiece, causing the working tool 49 to retract and push piston 27 upward a short distance. In this position, lower piston ring 35 and lower pressure area 47 will move above supply ports 75. Now, hydraulic fluid pressure from supply ports 75 will begin acting on lower pressure area 47 to raise piston 27. Hydraulic fluid lubricates lower bearing area 69 and upper bearing area 60 during the movement of piston 27. While in the start position, intermediate piston ring 37 will be slightly below signal port 77, and upper piston ring 39 will be slightly above return port 79. Signal port 77 and return port 79 will communicate with each other through the clearances surrounding piston intermediate section 17. Consequently, signal port 77 will still be low. Although upper piston ring 39 has now moved between return port 79 and control port 81, control port 81 still remains low.

Referring to FIG. 6, during the start position, signal port 87 is still at a low because it communicates with return port 89 due to the positions of the intermediate and upper piston rings 37, 39 (FIG. 2). As a result, inner pressure area 105 will be low. Outer pressure area 103 will remain high, maintaining slider 93 in the inner position shown. As piston 27 moves upward, fluid displaced above piston 27 flows into control port 91, through slider return ports 97 and into manifold return port 115. The fluid flows through return passage 117 into the tank of the hydraulic pump.

Figure 3:
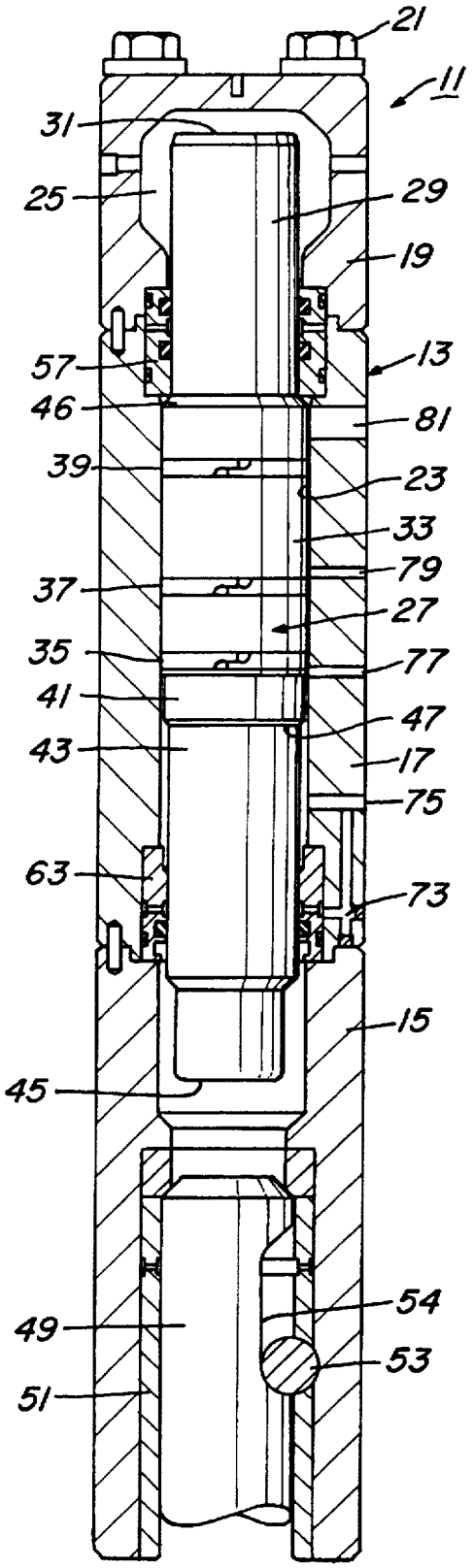
FIG. 3 is a sectional view of the impact tool of FIG. 1, showing the impact tool in an upper position.

Referring now to FIG. 3, piston 27 will continue its upward stroke until reaching the upper position shown. In that position, lower piston ring 35 has now moved from below to above signal port 77, causing signal port 77 to go high. Signal port 77 will communicate with supply ports 75 because of clearances between piston 27 and bore 23 below lower piston ring 35. Intermediate piston ring 37 has moved from below signal port 77 to a position between signal port 77 and return port 79. It now blocks communication between signal port 77 and return port 79, allowing signal port 77 to be at a high. Upper piston ring 39 is still located above return port 79 and below control port 81, and thus blocks any communication from control port 81 to return port 79.

Referring now to FIG. 6, the change in status of signal port 87 from a low to a high causes slider 93 to shift from the inner position shown to an outer position. The high at signal port 87 communicates through passage 113 to manifold signal port 111. This high pressure acts on inner pressure area 105. Although there is the same high pressure on outer pressure area 103, the greater area of inner pressure area 105 causes slider 93 to shift to the left to the outer position. When this occurs, slider ports 97 are blocked from communicating with manifold return port 115. The movement of slider 93 to the outer position opens manifold control port 101 to supply passage 99. High pressure will be acting on upper pressure area 46 (FIG. 3), creating a downward directed force that is greater than the upward directed force due to high pressure acting on the smaller lower pressure area 47. This net downward force, along with the force due to gas compression in chamber 25, causes the piston 27 to move downward to impact.

Referring to FIG. 4, as piston 27 moves downward to impact, the pressures at the various ports 75, 77, 79 remain the same until the point of impact. Although the pressure is high at supply ports 75, hydraulic oil will actually flow into supply ports 75 during the downstroke. The signal port 77 remains high until approximately the point of impact, at which time it will go low. The location of upper piston ring 39 above return port 79, and the location of intermediate piston ring 37 below signal port 77, causes the ports 77, 79 to communicate with each other.

Referring to FIG. 6, when valve signal port 87 goes low, the high pressure acting on inner pressure area 105 is removed from slider 93. This causes slider 95 to move back to the inner position because of the continuous supply of high pressure fluid on the outer pressure area 103. When moved to the right, slider return ports 97 will register with manifold return port 115 to place control port 91 again at a low. Slider 93 blocks supply pressure passage 99 from control port 91 as it slides to the inner position. The pressures at the ports 85, 87, 89 and 91 will thus be the same as during the start position in FIG. 2. This causes the cycle to repeat.

As piston 27 nears the bottom of the stroke, hydraulic fluid being pushed toward the lower bearing conical section 65 is diverted through relief ports 71 and 73 (FIG. 5) to supply ports 75. Although the pressure at supply ports 75 is high, the relief flow prevents the seal 67 from being subjected to very high pressure surges. Also, relieved section 41 prevents the trapping of fluid in the conical section 65 of lower bearing 63.

The invention has significant advantages. The use of piston rings enables greater clearances than in the prior art. The greater clearances reduce heat and reduce manufacturing costs. Also, wear is reduced on the piston. The use of a valve which has ports that register with radial ports in the housing avoids the requirement for axially extending ports in the housing.

While the invention has been shown in only one of its form, it should be apparent to those skilled in the art that it is not so limited, but it is susceptible to various changes without departing from the scope of the invention.

I claim:

1. An impact apparatus, comprising in combination:

a tubular housing with an axial bore;

a piston reciprocally carried in the bore and having a lower pressure area shoulder and an upper pressure area shoulder which is larger in cross-sectional area than the lower pressure area shoulder, the piston being movable between a lower rest position, an intermediate start position, an upper position, and an impact position;

a working tool located at a lower end of the bore for contact by the piston;

a fluid compression chamber at the upper end of the bore to supply energy to drive the piston from the upper position to the impact position;

a supply port extending through the housing into the bore;

a signal port spaced axially above the supply port and extending through the housing into the bore;

a return port spaced axially above the signal port and extending through the housing into the bore;

a control port spaced axially above the return port and extending through the housing into the bore;

axially spaced apart lower, intermediate and upper piston rings on the piston between the lower pressure area shoulder and the upper pressure area shoulder;

the piston rings and ports being positioned such that:

during the rest position, the lower piston ring and lower pressure area shoulder are below the supply port, the intermediate piston ring is between the supply port and the signal port, and the upper piston ring is between the signal port and return port;

during the start position, the lower piston ring and lower pressure area shoulder are above the supply port, the intermediate piston ring is between the supply port and the signal port, communicating the signal port with the return port, and the upper piston ring is between the return port and the control port;

during the upper position, the lower piston ring is above the signal port, communicating the signal port with the supply port, the intermediate piston ring is between the signal port and the return port, and the upper piston ring is between the return port and the control port; and during the impact position, the piston rings are positioned as during the start position; and valve means for providing hydraulic fluid supply pressure continuously to the supply port to raise the piston when the lower pressure area shoulder moves above the supply port in the start position, for providing a return conduit continuously to the return port, for providing a return conduit to the control port until the signal port begins receiving supply pressure at the upper position, then for providing supply pressure to the control port to act on the upper pressure area shoulder to drive the piston downward, and for changing the control port back to a return conduit when the signal port changes back to a return conduit in the impact position.

2. The apparatus according to claim 1, wherein the piston has a constant diameter from the lower piston ring to the upper piston ring.

3. The apparatus according to claim 1, wherein the piston rings are split metal rings.

4. The apparatus according to claim 1, wherein:

each of the piston rings has a width and each of the supply, signal, and return ports has a junction with the bore which has a diameter;

the diameter of the junction of the supply port being no greater than the width of the lower piston ring;

the diameter of the junction of the signal port being no greater than the width of the intermediate piston ring; and the diameter of the junction of the return port being no greater than the width of the upper piston ring.

5. The apparatus according to claim 1, wherein:

the lower piston ring has a width;

the supply port comprises a plurality of supply ports, spaced in a cluster on one side of the housing, each of the supply ports having a diameter; and the diameters of each of the supply ports is no greater than the width of the lower piston ring.

6. An impact apparatus, comprising in combination:

a tubular housing with an axial bore;

a piston reciprocally carried in the bore and having a lower pressure area shoulder and an upper pressure area shoulder which is larger in cross-sectional area than the lower pressure area shoulder, the piston being movable between a lower rest position, an intermediate start position, an upper position, and an impact position;

a working tool located at a lower end of the bore for contact by the piston;

a fluid compression chamber at the upper end of the bore to supply energy to drive the piston from the upper position to the impact position;

a plurality of axially spaced apart ports extending through the housing into the bore; and a plurality of axially spaced apart split, metal piston rings mounted on a constant diameter section of the piston for sealing to the bore of the housing, selected ones of the piston rings moving past selected ones of the ports during the movement of the piston between the start, upper and impact positions to control movement of the piston in cooperation with the valve means.

7. The apparatus according to claim 6, wherein:

said selected ones of the piston rings each have a width; and said selected ones of the ports each have a junction with the bore which has a diameter, the diameter of each of said selected ones of the ports being no greater than the width of each of the piston rings which moves past.

* * * * *